US007002285B2

(12) United States Patent
Mudra et al.

(10) Patent No.: US 7,002,285 B2
(45) Date of Patent: Feb. 21, 2006

(54) DISCHARGE LAMP WITH BULB FIXTURE ARRANGEMENT AND METHOD FOR MANUFACTURING THE SAME

(75) Inventors: István Mudra, Vac (HU); Szabolcs Bella, Budapest (HU); Pál Garamvölgyi, Budapest (HU)

(73) Assignee: General Electric Company, Schenectady, NY (US)

( * ) Notice: Subject to any disclaimer, the term of this patent is extended or adjusted under 35 U.S.C. 154(b) by 99 days.

(21) Appl. No.: 10/336,151

(22) Filed: Jan. 3, 2003

(65) Prior Publication Data

US 2004/0130255 A1 Jul. 8, 2004

(51) Int. Cl.
*H01J 5/48* (2006.01)
*H01J 5/50* (2006.01)

(52) U.S. Cl. ..... 313/318.01; 313/318.03

(58) Field of Classification Search ..... 313/318.01, 313/318.03, 318.05, 318.07, 318.08, 318.09, 313/318.1, 317; 439/613
See application file for complete search history.

(56) References Cited

U.S. PATENT DOCUMENTS 5,239,226 A * 8/1993 Seredich et al. ..... 313/318.01
5,291,092 A * 3/1994 Coushaine ..... 313/318.01
5,378,958 A 1/1995 van Heeswijk ..... 313/318.01
5,386,173 A * 1/1995 Kosmatka ..... 313/318.01
5,428,261 A * 6/1995 Wittig et al. ..... 313/318.1
5,627,428 A * 5/1997 Helbig et al. ..... 313/318.01
6,031,323 A * 2/2000 Behr et al. ..... 313/318.01
6,203,169 B1 * 3/2001 Coushaine et al. ..... 362/226
6,566,815 B1 * 5/2003 Heike et al. ..... 315/56
6,650,033 B1 * 11/2003 Mehan et al. ..... 313/318.08

OTHER PUBLICATIONS

Phillips Xenon HID (Koninklijke Philips Electronics N.V. (Eindhoven, NL) ), Xenon HID Eng. Jun. 2002.

* cited by examiner

*Primary Examiner*—Joseph Williams
*Assistant Examiner*—Peter Macchiarolo
(74) *Attorney, Agent, or Firm*—Fay, Sharpe, Fagan, Minnich & McKee, LLP

(57) ABSTRACT

A discharge lamp is disclosed, which comprises a discharge vessel sealed in a tubular envelope. The lamp has a lamp base covering an end part of the envelope, and fixing means for providing a substantially rigid fixing of the envelope to the lamp base. The fixing means comprises a metal clamp ring, which surrounds a part of the envelope external to the lamp base. A melt plastic lining is provided between the clamp ring and the envelope. The melt plastic lining substantially completely fills a space between the envelope and the clamp ring.

A method is also provided for manufacturing a discharge lamp as above. The method comprises the steps of providing a space between the clamp ring and the envelope, and providing a hot-melt plastic lining in the space between the clamp ring and the envelope. Subsequently, the plastic lining is melted, and substantially completely fills the space between the clamp ring and the envelope, establishing a tight and stable mechanical connection between the clamp ring and the envelope.

15 Claims, 3 Drawing Sheets

DISCHARGE LAMP WITH BULB FIXTURE ARRANGEMENT AND METHOD FOR MANUFACTURING THE SAME

BACKGROUND OF THE INVENTION

This invention relates to a discharge lamp, particularly a high pressure automotive headlight discharge lamp with an arrangement for fixing an envelope of the lamp to a lamp base. The invention further relates to a method for manufacturing such a discharge lamp.

A wide variety of automotive high pressure discharge lamps are known in the art. These lamps normally comprise a relatively small discharge vessel surrounded by a larger envelope. The envelope is sealed around the discharge vessel, creating a monolithic discharge vessel-envelope assembly. The light of the lamp is generated by a discharge arc between two electrodes, producing a small light spot with very high luminous intensity. The light spot of the lamp is subject to strict positioning tolerances in order to keep the prescribed optical parameters of the headlight, into which the discharge lamp is installed. The light spot of the discharge vessel is positioned by adjusting the complete discharge vessel-envelope assembly into a proper position relative to a lamp base of the lamp and fixing the envelope (and thereby also the discharge vessel) in the adjusted position.

The envelope is held in the adjusted position relative to the lamp base using various solutions. In the method disclosed in U.S. Pat. No. 5,627,428 the envelope is held in place with the help of an outer end of the envelope, which extends beyond the sealing area between the discharge vessel and the envelope. This outer end of the envelope extends into a plastic holder portion of the lamp base, and the holder portion is melted around the outer end of the envelope. The melting of the holder portion is done with high frequency induced heating, and for this purpose, metal inserts are provided in the plastic holder portion. The holder portion itself is also melt sealed relative to the external shell of the lamp base. The metal inserts have no further role in the lamp, but only to facilitate the heating of the plastic parts. The problem with this fixing method is that the envelope inevitably develops stress around the indented portions at the sealing to the discharge vessel, and tends to break at these indented portions due to excessive vibration and similar mechanical loads.

Another method to fix the discharge vessel relative to the lamp base is disclosed in U.S. Pat. No. 5,378,958. In this known discharge lamp, the discharge vessel is held in place with the help of a metal clamp ring, which clamps around an end portion of the discharge vessel. The clamp ring is provided with metal legs or tongues, connecting to a fixation member, which latter is embedded in the lamp base.

A similar method is used in the D2 type discharge lamps manufactured by Philips Corporation, and described in Xenon HID Catalogue (Philips, June 2000). In this known lamp construction, the discharge vessel is enclosed by an envelope, similarly to the lamp described in U.S. Pat. No. 5,627,428, and the envelope is sealed to the discharge vessel near to its ends. A metal clamp ring surrounds the envelope between the indented sealing regions, but in the vicinity of the lower end of the envelope, so that the discharge chamber of the discharge vessel is not covered by the clamp ring. The clamp ring in this manner holds the discharge vessel-envelope assembly much closer to its centre of gravity, which ensures better mechanical support and resistance against deflections relative to the lamp base. On the other hand, the thermal load on the clamp ring is relatively high, being closer to the discharge chamber.

Though the above method also largely eliminates the cracking of the envelope at the indented sealing portions, other problems remain. The clamp ring is a closed ring to ensure sufficient clamping force around the envelope. However, in order to ensure a certain degree of flexibility of the metal clamp ring, the clamp ring must be provided with slight undulations in a circumferential direction. These undulations allow for natural differences between the diameters of the tubular envelopes due to usual manufacturing tolerances. The undulations also take up a part of the stress when the glass envelope expands under increased temperatures. However, these undulations also allow a certain degree of deflection of the envelope, particularly under shock and vibration during normal use of the lamp, for example in an automotive headlight. This deflection of the envelope may cause a degradation of the optical parameters of the headlight.

Therefore, there is a need for a discharge lamp structure that ensures a stable, substantially deflection-free fixation of the discharge vessel-envelope assembly relative to the lamp base, and which does not require expensive components and complicated manufacturing facilities, and which may be integrated into various types of existing production lines in a simple manner.

SUMMARY OF THE INVENTION

In an exemplary embodiment of the present invention, there is provided a discharge lamp, which comprises a discharge vessel sealed in a tubular envelope. The lamp also comprises a lamp base covering an end part of the envelope and fixing means for providing a substantially rigid fixing of the envelope to the lamp base. The fixing means comprises a metal clamp ring surrounding a part of the envelope external to the lamp base. A melt plastic lining is provided between the clamp ring and the envelope. The melt plastic lining substantially completely fills a space between the envelope and the clamp ring.

In an exemplary embodiment of another aspect of the present invention, there is provided a method for manufacturing a discharge lamp. The method is applicable for such discharge lamps, which comprise a discharge vessel sealed in a tubular envelope, and a lamp base covering an end part of the envelope. Such lamps also have fixing means for providing an essentially rigid fixing of the envelope to the lamp base, where the fixing means comprises a metal clamp ring surrounding a part of the envelope external to the lamp base. The method comprises the provision of a space between the clamp ring and the envelope and the provision of a hot-melt plastic lining in the space between the clamp ring and the envelope. In the method, the plastic lining is melted and substantially completely fills the space between the clamp ring and the envelope, providing a stable mechanical connection between the clamp ring and the envelope.

In an exemplary embodiment of still another aspect of the invention, there is also provided a fixture arrangement for fixing an envelope of a discharge lamp to a lamp base. The fixture arrangement comprises a metal clamp ring for surrounding a part of a tubular envelope, and legs attached to the clamp ring with one end. Another end of the legs extend away from the clamp ring, for insertion into a lamp base. The clamp ring comprises a hot-melt plastic lining, which may be melted to form a melt connection between the clamp ring and a lamp envelope inserted into the clamp ring.

The hot-melt plastic lining between the clamp ring ensures a stable and substantially deflection-free support of the lamp envelope. With a suitable choice of material, the plastic lining can take up the mechanical stress between the clamp ring and the envelope as the latter expands due to the high operating temperature of the discharge chamber. At the same time, an advantageously stable support is provided, firstly because the envelope is held close to its centre of gravity, secondly because the envelope is held between the two sealed portions, so the mechanical stress—particularly the bending stress—on the sealed portions is low. Since the plastic lining completely fills the space between the clamp ring and the envelope, practically no deflection occurs as a result of a relative movement between the clamp ring and the envelope. As a further advantage, the suggested fixation method requires only a very small amount of a suitably heat resistant hot-melt plastic material. The clamp ring itself can serve as the metal component for a HF induced heating of the plastic lining, and no additional elements are needed in the discharge lamp structure.

BRIEF DESCRIPTION OF DRAWINGS

The invention will be now described with reference to the enclosed drawings, where.

DETAILED DESCRIPTION OF THE INVENTION

Figure 1:
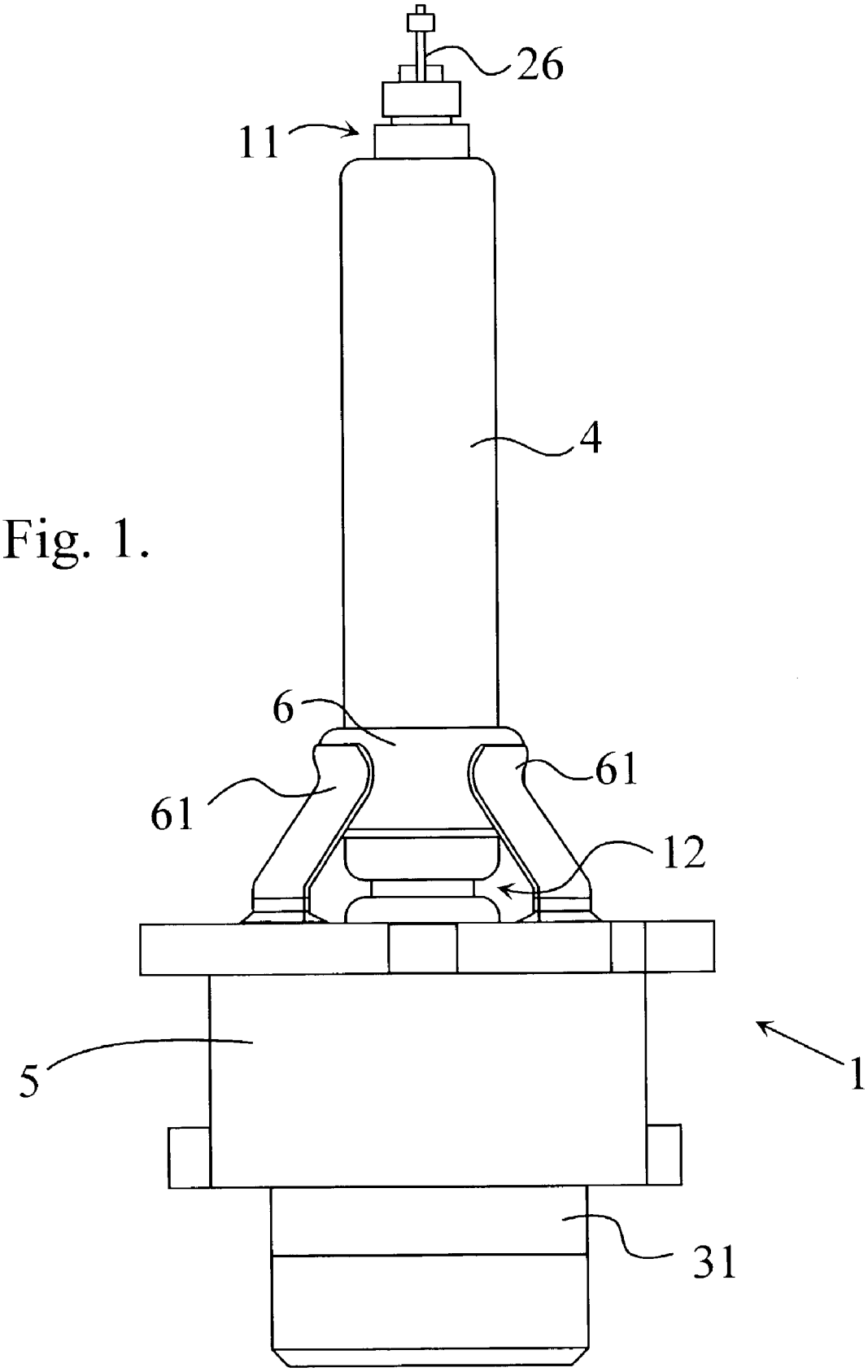
FIG. 1 is a side elevational view of an automotive high pressure discharge lamp.
Figure 2:
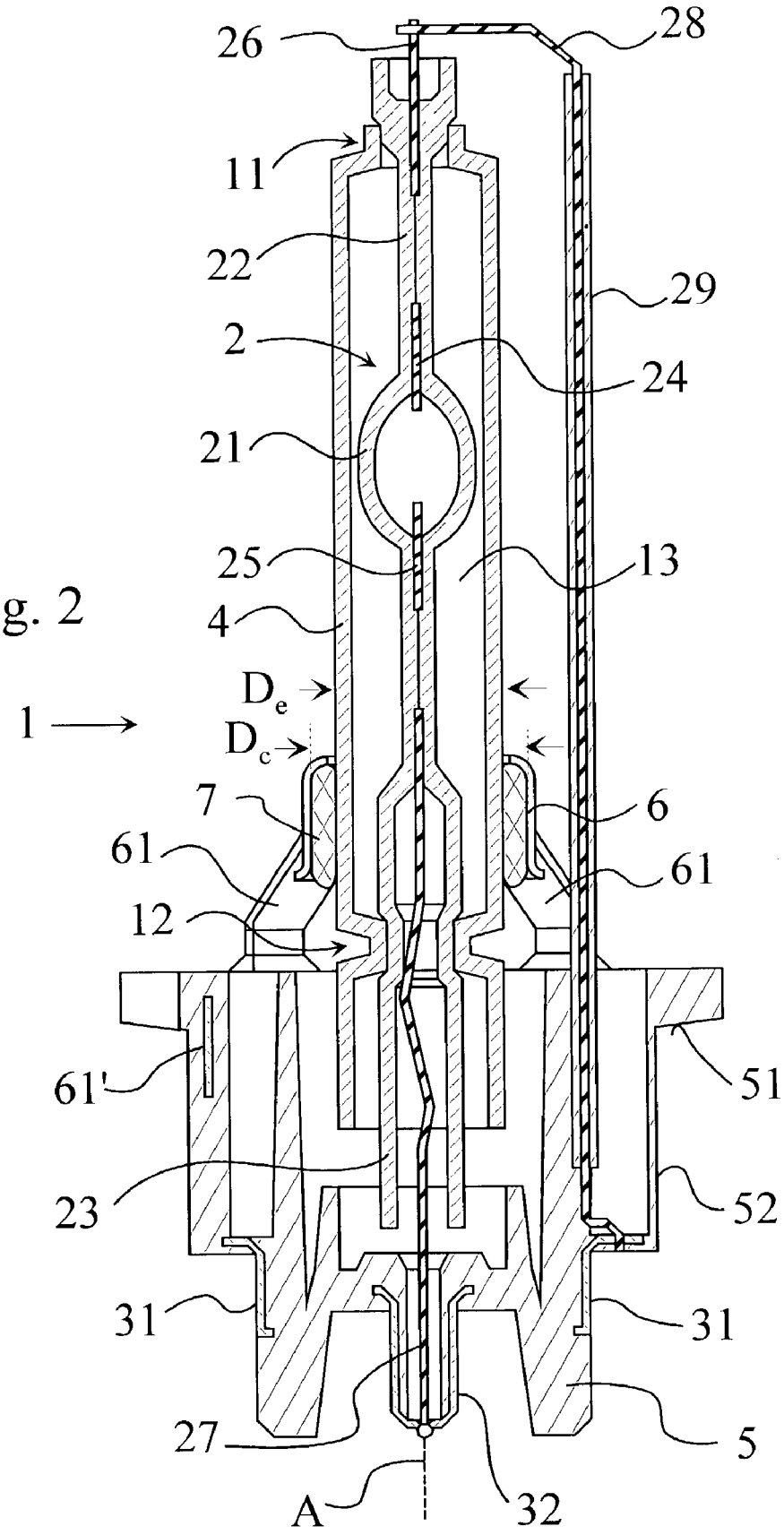
FIG. 2 is a cross section of the lamp shown in FIG. 1, illustrating its internal structure, taken along the central axis of the lamp, in a plane perpendicular to the plane of FIG. 1.

Referring now to FIGS. 1 to 2, there is shown a high pressure discharge lamp 1 for automotive purposes. This is a so called D2 type lamp, which has a sealed discharge vessel 2. The discharge vessel 2 consists of a discharge chamber 21, and an upper end part 22 and a lower end part 23. These latter are sealed, so that a suitable high pressure gas atmosphere is maintained in the discharge chamber 21, for example a xenon atmosphere of 8–10 bar. The end parts 22 and 23 enclose electrodes 24,25 and lead wires 26,27. The lead wires 26,27 are connected to the electrodes 24,25 through molybdenum foils, in a known manner. The upper lead wire 26 connects to a first contact 31 through another connecting wire 28, while the lower lead wire 27 connects to a second contact 32 directly. The connecting wire 28 is insulated by a sheath 29, e.g a steatite tube. The contacts 31,32 are mechanically supported by the lamp base 5, which latter also supports the discharge vessel 2, as will be explained below. The contacts 31,32 are welded or soldered to the ends of the connecting wire 28 and the lead wire 27, respectively.

The discharge vessel 2 is surrounded by an external envelope 4. The envelope 4 is substantially tubular, and it is sealed around the discharge vessel 2 at indented sealing portions 11 and 12. This creates a closed volume 13 between the discharge vessel 2 and the envelope 4, which normally contains air or nitrogen gas. The sealing also provides a rigid mechanical connection between the discharge vessel 2 and the envelope 4, so that the discharge vessel-envelope assembly functions as a single structural unit in the mechanical construction of the lamp 1.

The discharge vessel-envelope assembly is mechanically fixed to the lamp base 5 by suitable fixing means. The purpose of these fixing means is to provide a substantially rigid fixing of the discharge vessel 2 and the envelope 4 to the lamp base 5, for the reasons mentioned above. The term "substantially rigid" indicates that this fixation should be as rigid as possible, and it is intended to minimize the relative movement between the discharge chamber 21 and the reference points of the lamp base 5, such as the surface 51, or the central axis A of the lamp base 5 as defined by the cylindrical surface 52. For this purpose, the fixing means of the lamp 1 comprises a metal clamp ring 6 surrounding a part of the envelope 4 external to the lamp base 5. With other words, the clamp ring 6 clamps around a part of the envelope 4 that stands out from the lamp base 5, and in this manner, the clamp ring 6 itself is also outside the lamp base 5. As best seen in FIGS. 1 and 2, the clamp ring 6 clamps the envelope 4 in a region between the two sealing portions 11 and 12, namely closer to the lower sealing portion 12, and sufficiently far from the discharge chamber 21, so that the emission of light by the discharge arc in the discharge chamber 21 is substantially undisturbed by the clamp ring 6.

The clamp ring 6 is fixed to the lamp base 5 with a number of tongue-like metal legs 61, typically four. The legs 61 are welded to an external surface portion of the clamp ring 6. Such an embodiment is shown in FIGS. 1 and 2. Alternatively, the legs 61 may be integral with the clamp ring 6, i.e. they may be formed from the same body of material, such as a sheet metal by, for example, a cutting and pressing operation. The lamp base 5 may be molded around an end of the metal legs 61, so that they are firmly embedded in the material of the lamp base 5. For example, the legs 61 may extend from a base ring 61', which is completely enclosed by the material of the lamp base 5, as illustrated in FIG. 2.

In another possible embodiment, the ends of the metal legs 61 may be pressed into corresponding receiving slots (not shown) of the lamp base. This allows a more economic production of the plastic body of the lamp base.

In order to ensure a stable and tight mechanical connection between the envelope 4 and the clamp ring 6, a melt plastic lining 7 is provided between the clamp ring 6 and the envelope 4. The melt plastic lining 7 substantially completely fills the space between the envelope 4 and the clamp ring 6, and a melt connection is established therewith. With other words, the plastic lining 7 fills the gap between the external surface portion of the envelope 4 and the internal surface of the clamp ring 6. The plastic lining 7 is made of a suitably heat-resistant material, which withstands temperatures as high as 240–260° C. Such materials are readily available in commerce, for example polyether-ether-ketone (PEEK) materials, sold under the trade name Victrex®. These have a softening temperature which is higher than 260° C. The melting temperature of this material is approx. 340° C.

As best seen in FIG. 2, the inner diameter $D_c$ of the clamp ring 6 is positively larger than the corresponding outer diameter $D_e$ of the envelope 4. In this manner, the space between the envelope 4 and the clamp ring 6, and thereby also the plastic lining 7 substantially completely surrounds the envelope 4. With other words, there is an insulating plastic layer all the way around the envelope 4, and there is less heat transfer to the clamp ring 6 from the envelope 4. Consequently, the heat load on the lamp base 5 from the lower ends of the legs 61 is also less. The plastic lining 7 also acts as a cushion between the glass envelope 4 and the metal clamp ring 6, and provides a more even distribution of the clamping force around the envelope 4, as compared with a direct metal-glass contact.

The plastic lining 7 is melted around the envelope 4 during the production of the lamp 1. In the course of manufacturing of the discharge lamp 1, the various manufacturing steps are essentially the same as with the known manufacturing methods. Largely, a discharge vessel-envelope assembly is prepared, which is mechanically fastened to a lamp base, and the electric contacts between the discharge electrodes and the contact members of the lamp base are established. The final mechanical fastening or fixation of the envelope relative to the lamp base is performed after adjusting the position of the discharge chamber or the discharge arc relative to certain reference points of the lamp base. The only difference is in the way that the envelope is mechanically fixed in the adjusted position. In the proposed method, instead of using a tight-fitting clamp ring, a space is provided between the clamp ring 6 and the envelope 4, by selecting the inner diameter $D_c$ of the clamp ring 6 larger than the outer diameter $D_e$ of the envelope 4, as explained above. A hot-melt plastic lining 7 is inserted in the space between the clamp ring 6 and the envelope 4. The plastic lining 7 is melted, so that it completely fills the space between the clamp ring and the envelope.

The melting of the plastic lining 7 may be effected in a number of ways, for example with infrared radiation, a directed heating flame or HF electromagnetic field. The last solution is particularly suitable, because the metal clamp ring 6 may be readily exploited for this purpose, and the envelope 4 itself will not be heated excessively. The plastic lining 7 is typically heated to a temperature of 350–500° C. The complete heating process of the plastic lining 7 is very fast, requiring only a few seconds. The molten plastic rapidly cools, and shrinks slightly during cooling, providing a strong clamping around the envelope 4.

As explained above, the position of the envelope 4 is adjusted relative to the lamp base 5 before melting the plastic lining 7. After the melting of the plastic lining 7, the adjusted position of the envelope relative to the lamp is retained during the cooling period of the plastic lining 7, so that an unintentional misalignment of the envelope 4 and thereby that of the discharge vessel 2 during cooling is prevented. In a practical realization of the manufacturing method, first the plastic lining 7 in inserted in the clamp ring 6, and only thereafter the envelope 4 is inserted in the clamp ring 6. However, theoretically it is also possible to insert first the discharge vessel-envelope assembly into the clamp ring 6, and thereafter to insert the plastic lining 7 between the clamp ring 6 and the envelope 4. In both cases, the melting of the plastic lining 7 is done while the envelope is securely held in its adjusted, proper position, which is permanently fixed when the plastic lining 7 cools and hardens again. The electrical connections between the contacts 31,32 and the lead wires 26,27 may be completed both before and after the adjustment of the envelope 4 and the melting of the plastic lining 7.

Figure 3:
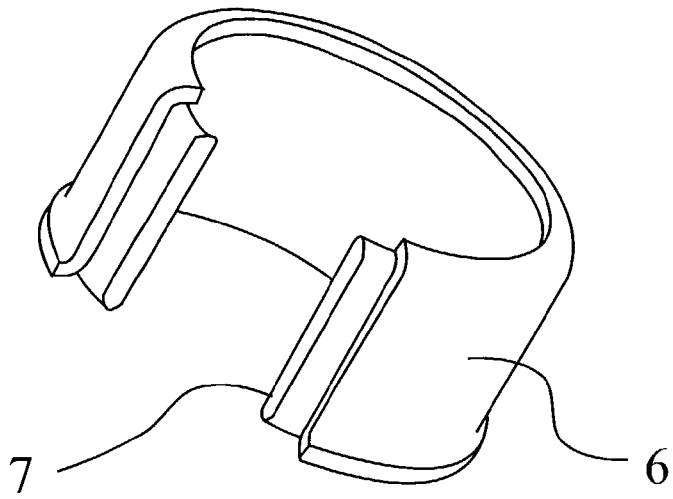
FIG. 3 is an enlarged view of the clamp ring and the hot-melt plastic lining insert shown in FIG. 2, with an illustrative cut-out to show the plastic lining within the clamp ring.
Figure 4:
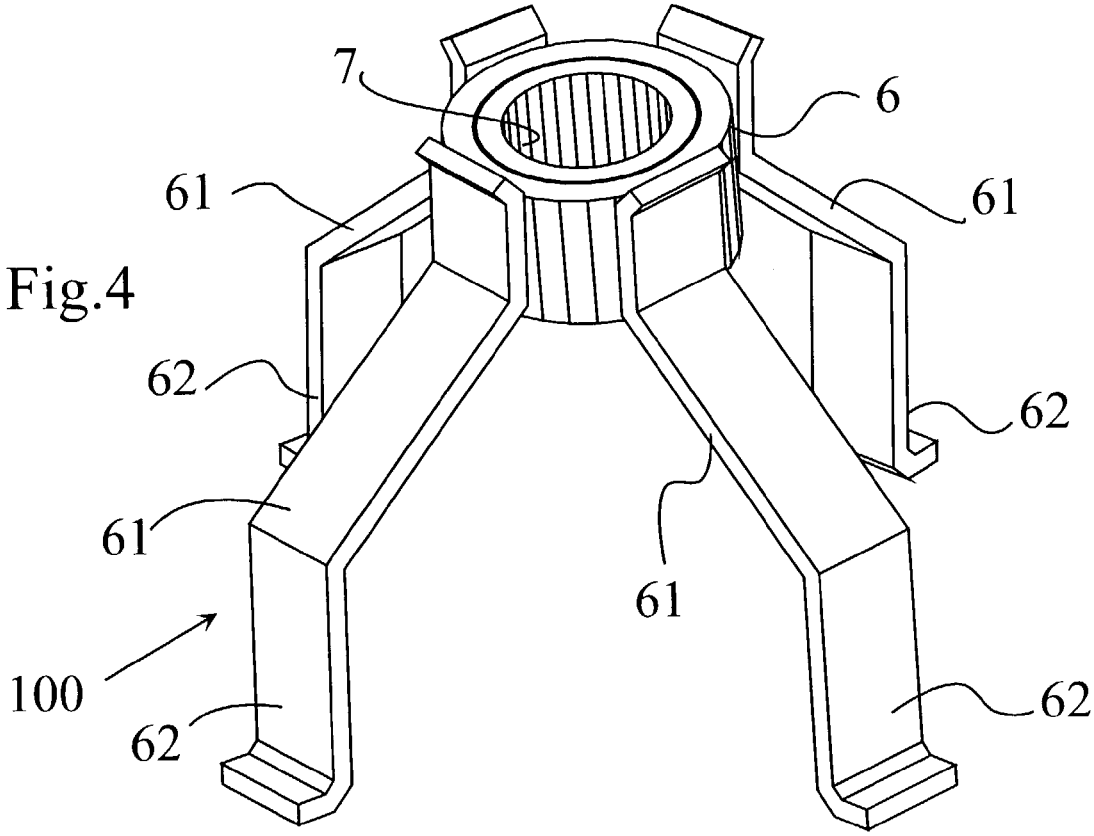
FIG. 4 is a perspective view of another embodiment of a bulb fixture arrangement for discharge lamps similar to those shown in FIGS. 2 and 3.

From the above, it is clear that the lamp 1 is manufactured using a bulb fixture arrangement which comprises a metal clamp ring 6 for surrounding a part of a tubular envelope, and legs 61 attached to the clamp ring 6 with one end and another end 62 of the legs 61 extending away from the clamp ring 6. The extending ends 62 are intended for insertion into a lamp base 5. As explained above, the clamp ring 6 comprises a hot-melt plastic lining 7, which may be melted around the envelope, thereby fixing it relative to the clamp ring 6 and indirectly relative to the lamp base which receives the extending ends 62 of the legs 61 of the fixture arrangement. Such a fixture arrangement 100 is shown by itself in FIG. 4., in a slightly different embodiment as compared with that shown in FIGS. 1 to 3. As explained above, the legs 61 may be welded to the clamp ring 6, (as shown in FIGS. 2 and 4), or the legs may be integral with the clamp ring (not shown).

The fixing method using the plastic lining may be readily integrated into existing lamp manufacturing lines, without negatively affecting cycle time or other production parameters. The method practically eliminates the misalignments of the discharge chamber and the light spot relative to the lamp base, which are caused by vibration, shock and similar mechanical effects. It has been shown that any relative movement between the lamp base and the discharge chamber is only due to the flexibility of the supporting legs of the clamp ring, but practically no relative movement could be observed between the clamp ring and the envelope. Further, it has been found that the proposed method allows generally larger tolerances in some other production steps, such as the positioning tolerances of the clamp support legs relative to the lamp base.

The invention is not limited to the shown and disclosed embodiments, but other elements, improvements and variations are also within the scope of the invention. It is clear for those skilled in the art that the same principles may be applied to other types of low-pressure or high-pressure discharge lamps, and not only to single-ended automotive lamps such as shown in FIGS. 1 and 2. For example, the proposed manufacturing method and the bulb fixture arrangement is applicable with all types of lamps where a glass tubular element must be exactly positioned and retained in its position.

What is claimed is:

1. A discharge lamp, comprising:

a discharge vessel sealed in a tubular envelope;

a lamp base covering an end part of the envelope; and fixing means for providing a substantially rigid fixing of the envelope to the lamp base, the fixing means comprising:

a metal clamp ring surrounding a part of the envelope external to an outer surface of the lamp base, an internal surface of the clamp ring and an external surface portion of the envelope defining a surrounding space between the envelope and the clamp ring, the inner diameter of the clamp ring being positively larger than the corresponding outer diameter of the envelope, so that the space between the envelope and the clamp ring substantially completely surrounds the envelope, and a melt plastic lining external to the outer surface of the lamp base between the internal surface of the clamp ring and the external surface portion of the envelope, the melt plastic lining substantially completely filling the space between the envelope and the clamp ring.

2. The discharge lamp of claim 1, in which softening temperature of the plastic lining is higher than 260° C.

3. The discharge lamp of claim 1, in which the plastic lining is made of a polyether-ether-ketone (PEEK) material.

4. The discharge lamp of claim 1, in which the clamp ring is fixed to the lamp base with metal legs.

5. The discharge lamp of claim 4, in which the legs are welded to an external surface portion of the clamp ring.

6. The discharge lamp of claim 4, in which the legs are integral with the clamp ring.

7. The discharge lamp of claim 4, in which an end of the metal legs are pressed into corresponding receiving slots of the lamp base.

8. The discharge lamp of claim 4, in which the lamp base is molded around an end of the metal legs.

9. A method for manufacturing a discharge lamp, the discharge lamp comprising:

a discharge vessel sealed in a tubular envelope, a lamp base covering an end part of the envelope, fixing means for providing an essentially rigid fixing of the envelope to the lamp base, the fixing means comprising a metal clamp ring surrounding a part of the envelope external to an outer surface of the lamp base, the clamp ring and the envelope defining a surrounding space between the envelope and the clamp ring, the inner diameter of the clamp ring being positively larger than the corresponding outer diameter of the envelope, so that the space between the envelope and the clamp ring substantially completely surrounds the envelope, the method comprising the steps of:

providing a hot-melt plastic lining external to the outer surface of the lamp base in the space between the clamp ring and the envelope, melting the plastic lining and substantially completely filling the space between the clamp ring and the envelope.

10. The method of claim 9, further comprising the steps of:

inserting the plastic lining in the clamp ring, and thereafter inserting the envelope in the clamp ring.

11. The method of claim 9, further comprising the steps of:

adjusting a position of the envelope relative to the lamp base before melting the plastic lining, and after the melting of the plastic lining, retaining the adjusted position of the envelope relative to the lamp base during a cooling period of the plastic lining.

12. The method of claim 9, in which the melting of the plastic lining is effected with at least one of (i) infrared radiation (ii) heating flame or (iii) HF electromagnetic field.

13. A fixture arrangement for fixing an envelope of a discharge lamp to a lamp base, comprising:

a metal clamp ring external to an outer surface of the lamp base for surrounding a part of a tubular envelope external to the outer surface of the lamp base, an internal surface of the clamp ring being concentrically spaced from an external surface portion of the envelope thereby defining a concentric space between the envelope and the clamp ring, the space substantially completely surrounds the envelope, the clamp ring comprising a hot-melt plastic lining which when melted substantially completely filling the space between the envelope and the clamp ring; and legs attached to the clamp ring with a first end and a second end of the legs extending away from the clamp ring, for insertion into the lamp base, the second ends of the legs being secured to an inner surface of the lamp base.

14. The fixture arrangement of claim 13, in which the legs are welded to an external surface portion of the clamp ring.

15. The fixture arrangement of claim 13, in which the legs are integral with the clamp ring.

* * * * *